US006991489B2

(12) United States Patent
Yang et al.

(10) Patent No.: US 6,991,489 B2
(45) Date of Patent: Jan. 31, 2006

(54) CONNECTION DEVICE

(75) Inventors: Shan-Yen Yang, Taoyuan (TW); Xiao-Ning Sun, Suzhou (TW)

(73) Assignee: Benq Corporation, Taoyuan (TW)

( * ) Notice: Subject to any disclaimer, the term of this patent is extended or adjusted under 35 U.S.C. 154(b) by 15 days.

(21) Appl. No.: 10/803,336

(22) Filed: Mar. 18, 2004

(65) Prior Publication Data

US 2004/0185699 A1 Sep. 23, 2004

(30) Foreign Application Priority Data

Mar. 19, 2003 (TW) ..... 92204277 U

(51) Int. Cl.
*H01R 12/24* (2006.01)

(52) U.S. Cl. ..... 439/492

(58) Field of Classification Search ..... 439/492, 439/62, 67, 77, 493, 495, 931, 874, 660, 439/883, 637, 499

See application file for complete search history.

(56) References Cited

U.S. PATENT DOCUMENTS

| | | | | |
|---|---|---|---|---|
| 3,881,796 A | * | 5/1975 | Saunders | 439/422 |
| 4,124,266 A | * | 11/1978 | Wagstaff | 439/422 |
| 4,252,703 A | | 2/1981 | Patzschke et al. | |
| 4,544,687 A | | 10/1985 | Schupp et al. | |
| 4,609,446 A | | 9/1986 | Geist et al. | |
| 4,837,291 A | | 6/1989 | Paar | |
| 4,963,104 A | * | 10/1990 | Dickie | 439/460 |
| 5,240,420 A | * | 8/1993 | Roberts | 439/62 |
| 6,575,769 B1 | * | 6/2003 | Takeuchi et al. | 439/74 |
| 6,673,877 B2 | | 1/2004 | Paar et al. | |

FOREIGN PATENT DOCUMENTS

| | | |
|---|---|---|
| CA | 1 218 488 | 2/1987 |
| DE | 30 41 700 | 6/1982 |
| DE | 33 00 583 | 7/1984 |
| DE | 33 11 513 | 10/1984 |
| EP | 0 004 090 | 9/1979 |
| EP | 0 249 850 | 12/1987 |
| EP | 1 208 187 | 4/2002 |
| EP | 1 233 034 | 8/2002 |
| WO | WO-01/16269 | 3/2001 |

* cited by examiner

*Primary Examiner*—J. F. Duverne
(74) *Attorney, Agent, or Firm*—Snell & Wilmer L.L.P.

(57) ABSTRACT

The present invention provides a connection device for connecting an electrical device. The connection device includes a dielectric housing having a slot formed therein to allow the electrical device to plug in. The slot includes a top surface and a bottom surface. A first bulge portion and a second bulge portion extend downward from the top surface. A third bulge portion and a fourth bulge portion extend upward from the bottom surface. The first bulge portion corresponds to the third bulge portion for clamping the electrical device. The second bulge portion corresponds to the fourth bulge portion for electrically coupling to the electrical device.

18 Claims, 4 Drawing Sheets

CONNECTION DEVICE

CROSS-REFERENCE TO RELATED APPLICATION

This application claims priority of Taiwan Patent Application Serial No. 092204277 entitled "Connection Device", filed Mar. 19, 2003.

FIELD OF THE INVENTION

The present invention relates to a connection device. Particularly, the present invention relates to a connection device for connecting to a flat flex cable.

BACKGROUND OF THE INVENTION

FIG. 1 shows a prior art connection device for connecting a first electrical device 100 to a second electrical device 101. As shown in FIG. 1, the connection device includes a dielectric housing 200. The dielectric housing 200 has a slot 202 for plugging in the first electrical device 100. The slot 202 defines a top surface 204 and a bottom surface 206. A first bulge portion 301 extends downward from the top surface 204, and a second bulge portion 303 extends upward form the bottom surface 206. A conductive layer 300 is selectively formed on the surface of the first bulge portion 301, and/or a conductive layer 400 is selectively formed on the surface of the second bulge portion 303. The first bulge portion 301 corresponds to the second bulge portion 303 for electrically coupling to the first electrical device 100.

As shown in FIG. 1, the first electrical device 100 has a single point of contact with the connection device. Thus, the first electrical device 100 tends to shift or rotate around the single point of contact when the first electrical device 100 moves relative to the second electrical device 101. After extended use, the first electrical device 100 often becomes loose, resulting in poor contact, which in turn leads to low electrical connectivity and poor signal transmission. This phenomenon is especially common among optical pick-up head connection devices in optical disc drives.

Therefore, a new connection device is required to improve the connection between the first electrical device 100 and the second electrical device 101 so that poor contact or poor signal transmission does not occur when the second electrical device 101 moves or rotates relatively to the first electric device 100.

SUMMARY OF THE INVENTION

It is one aspect of the present invention to provide a connection device for connecting a first electrical device to a second electrical device.

It is another aspect of the present invention to provide a connection device for preventing the first electrical device from shifting or rotating so that poor contact or poor signal transmission does not occur.

The connection device includes a dielectric housing having a slot formed therein to allow the electrical device to plug in. The slot includes a top surface and a bottom surface. A first bulge portion and a second bulge portion extend downward from the top surface. A third bulge portion and a fourth bulge portion extend upward from the bottom surface. The first bulge portion corresponds to the third bulge portion for clamping the electrical device. The second bulge portion corresponds to the fourth bulge portion for electrically coupling to the electrical device. The distance between the first bulge portion and the third bulge portion is larger than the distance between the second bulge portion and the fourth bulge portion.

DETAILED DESCRIPTION

Figure 1:
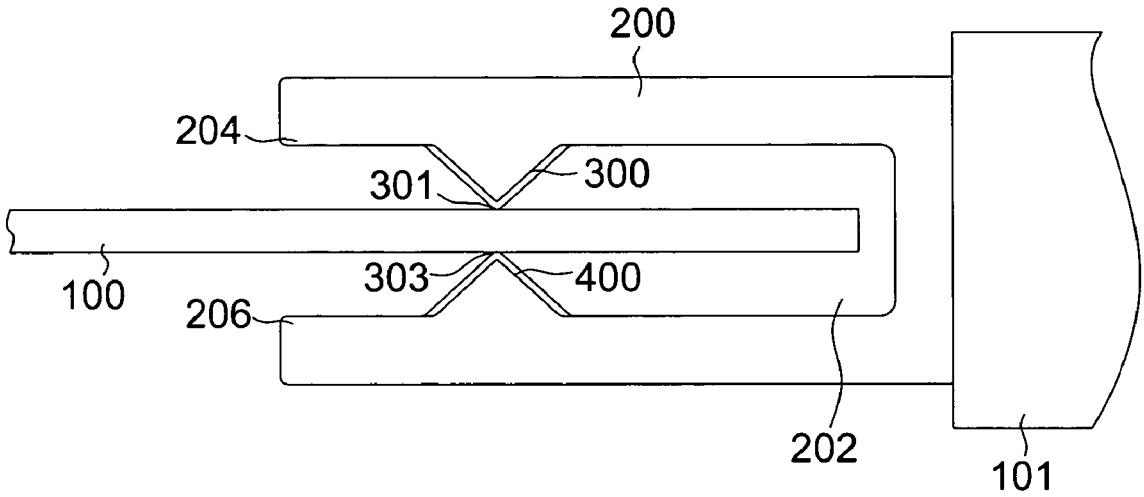
Fig.1(PRIOR ART)
FIG. 1 is a cross-sectional view of the prior art connection device.
Figure 2:
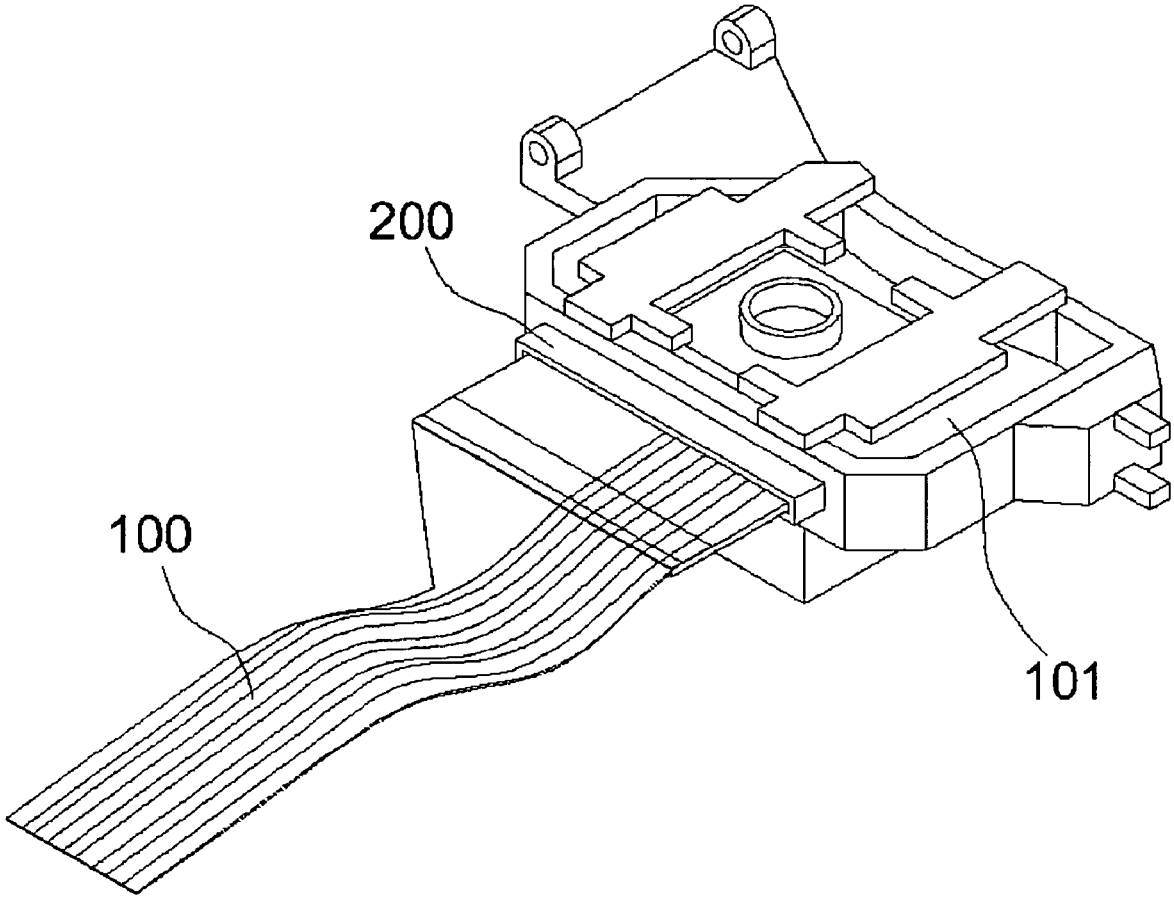
FIG. 2 is a connection device in accordance with the present invention.

As shown in FIG. 2, the present invention provides a connection device for connecting a first electrical device 100 to a second electrical device 101. The first electrical device 100 can be a flat flex cable (FFC), a flexible printed circuit (FPC), a wire, a cable, a golden finger, a membrane circuit, or the like. The second electrical device 101 can be an optical pick-up head, a photo sensor, a motor, a speaker, an optical disc drive, or any other similar device. In this embodiment, the first electrical device 100 is a flat flex cable and the second electrical device 101 is an optical pick-up head. The optical pick-up head connects to the flat flex cable by the connection device in accordance with the present invention.

Figure 3:
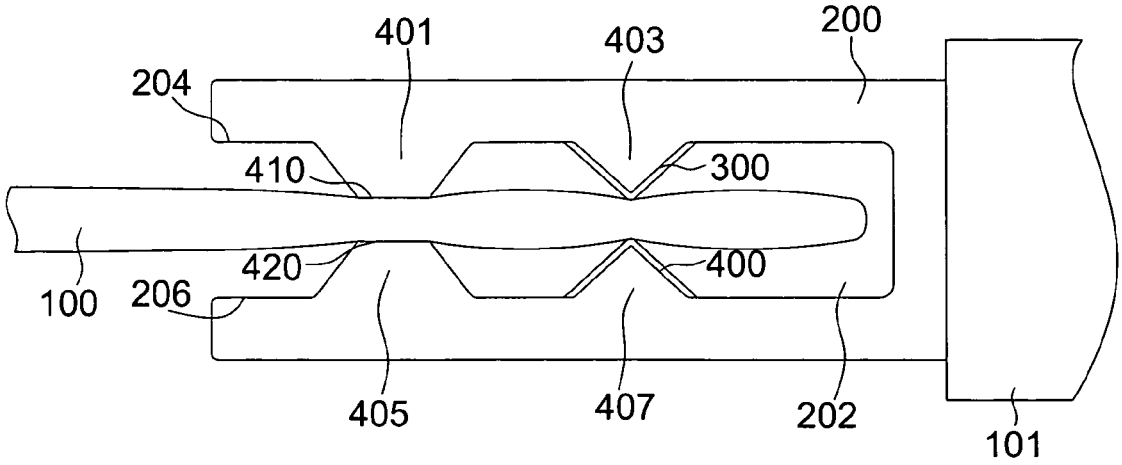
FIG. 3 is a cross-sectional view of a connection device of a first embodiment in accordance with the present invention.

FIG. 3 is a cross-sectional view of a connection device of a first embodiment in accordance with the present invention. As shown in FIG. 3, the connection device includes a dielectric housing 200. The dielectric housing 200 has a slot 202 for plugging in the first electrical device 100. The slot 202 defines a top surface 204 and a bottom surface 206. A first bulge portion 401 and a second bulge portion 403 extend downward from the top surface 204 of the slot 202. A third bulge portion 405 and a fourth bulge portion 407 extend upward from the bottom surface 206 of the slot 202. The first bulge portion 401 corresponds to the third bulge portion 405 for clamping the first electrical device 100. The second bulge portion 403 corresponds to the fourth bulge portion 407. Either the second bulge portion 403 selectively has a conductive layer 300 for electrically coupling to the first electrical device 100, and/or the fourth bulge portion 407 selectively has a conductive layer 400 for electrically coupling to the first electrical device 100. It should be noted that the conductive layer 300 of the second bulge portion 403 and the conductive layer 400 of the fourth bulge portion 407 may be concurrently applied. In addition, the first bulge portion 401 and the third bulge portion 405 may selectively have a conductive layer.

Furthermore, the first bulge portion 401 includes a first horizontal surface 410 and the third bulge portion 405 includes a second horizontal surface 420. With larger contact areas between the first horizontal surface 410 and the first electric device 100, and between the second horizontal surface 420 and the first electric device 100, the present invention clamps the first electrical device 100 more firmly than the prior art. When an external force (e.g. shock, vibration, etc) accidentally acts on the first electrical device 100, the clamping force between the first horizontal surface 410 and the second horizontal surface 420 prevents the first electrical device 100 from shifting or rotating.

Figure 4:
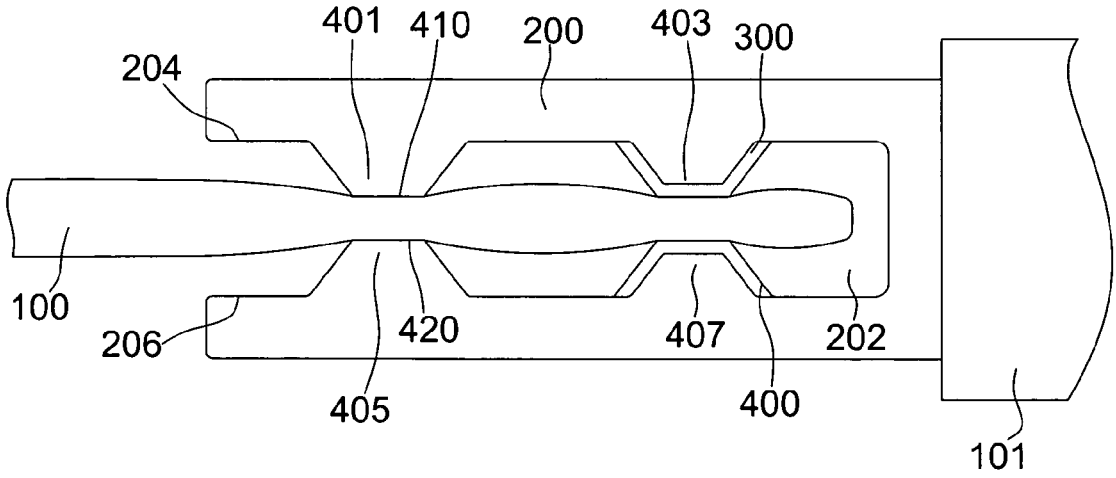
FIG. 4 is a cross-sectional view of a connection device of a second embodiment in accordance with the present invention.

FIG. 4 is a cross-sectional view of a connection device of a second embodiment in accordance with the present invention. As shown in FIG. 4, the second bulge portion 403 and the fourth bulge portion 407 each further includes a horizontal surface to provide additional clamping force. It should be noted that although the first horizontal surface 410 and the second horizontal surface 420 are shown in pairs in FIG. 3 and FIG. 4, those skilled in the art could easily know that they may be applied independently.

Figure 5:
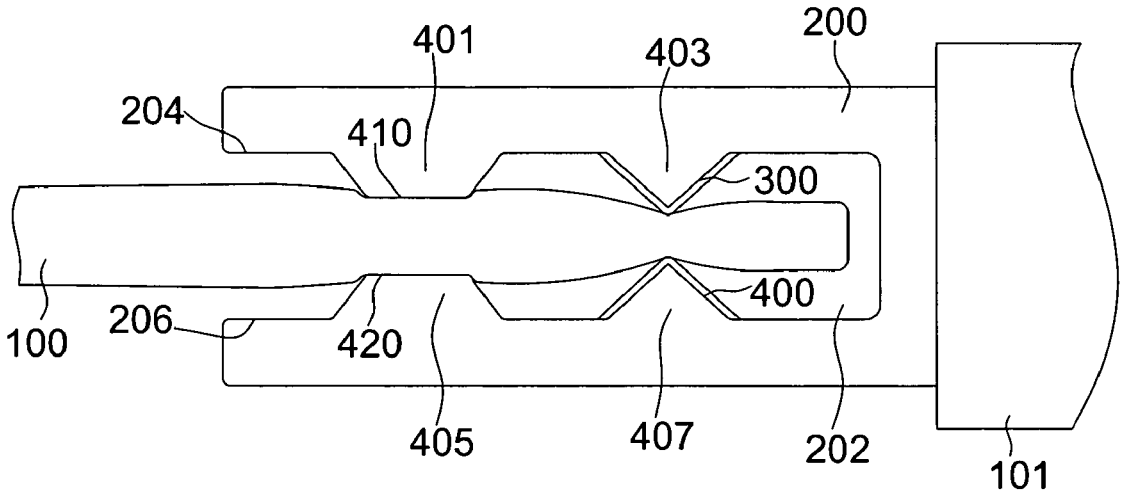
FIG. 5 is a cross-sectional view of a connection device of a third embodiment in accordance with the present invention.

FIG. 5 is a cross-sectional view of a connection device of a third embodiment in accordance with the present invention. As shown in FIG. 5, the distance between the first bulge portion 401 and the third bulge portion 405 is larger than the distance between the second bulge portion 403 and the fourth bulge portion 407. The first bulge portion 401 and the third bulge portion 405 will compress the first electrical device 100 while clamping the first electrical device 100. The smaller distance between the second bulge portion 403 and the fourth bulge portion 407 ensures good electrical contact with the first electrical device 100 even when the first electrical device 100 is compressed and becomes thinner.

As shown in FIG. 3 to FIG. 5, it should be noted that the connection device clamps the first electrical device 100 by using the first bulge portion 401 in conjunction with the third bulge portion 405 and by using the second bulge portion 403 in conjunction with the fourth bulge portion 407. These two pairs of clamping regions can provide better clamping force to hold the first electrical device 100 in place. When the external force accidentally acts on the first electrical device 100, the first bulge portion 401 and the third bulge portion 405 serve as a buffer region to decrease the effect of the external force. Thus, the second bulge portion 403 and the fourth bulge portion 407 will not be affected by the external force and will keep good electrical connectivity with the first electrical device 100, ensuring good electrical current and signal transmission.

Figure 6:
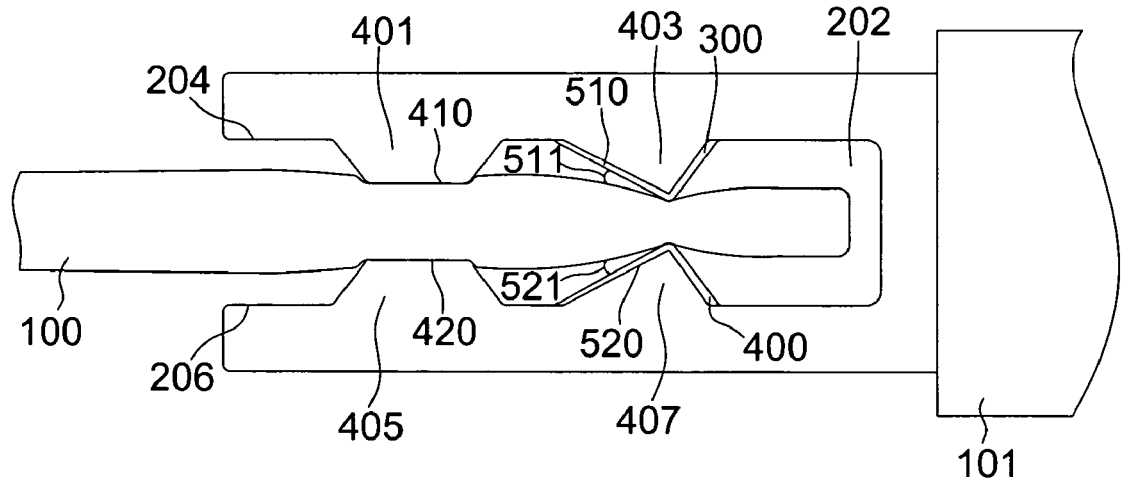
FIG. 6 is a cross-sectional view of a connection device of a fourth embodiment in accordance with the present invention.

FIG. 6 is a cross-sectional view of a connection device of a fourth embodiment in accordance with the present invention. As shown in FIG. 6, the second bulge portion 403 further includes a first sloping surface 510, and the fourth bulge portion 407 further includes a second sloping surface 520. When the first electrical device 100 is plugged into the slot 202, the first sloping surface 510 and the second sloping surface 520 serve as guiding surfaces. In this embodiment, a first angle 511 between 30 and 60 degrees is formed between the first sloping surface 510 and the top surface of the first electrical device 100, and a second angle 521 between 30 and 60 degrees is formed between the second sloping surface 520 and the bottom surface of the electrical device 100. It should be noted that although the first sloping surface 510 and the second sloping surface 520 are shown in pairs in FIG. 6, those skilled in the art could easily know that they might be applied independently.

While the preferred embodiments and applications of the invention have been described, it is apparent to those skilled in the art that the objects and features of the present invention are only limited as set forth in the claims attached hereto.

What is claimed is:

1. A connection device for connecting a flexible printed circuit, the connection device comprising:

a dielectric housing, the dielectric housing including a slot for plugging in the flexible printed circuit, the slot defining a top surface and a bottom surface;

a first bulge portion and a second bulge portion extending downward from the top surface of the slot; and a third bulge portion and a fourth bulge portion extending upward from the bottom surface of the slot;

wherein the first bulge portion corresponds to the third bulge portion, and a distance between the first and the third bulge portion is smaller than a thickness of the flexible printed circuit for clamping the flexible printed circuit, and wherein the second bulge portion corresponds to the fourth bulge portion for electrically coupling to the flexible printed circuit, and wherein the second bulge portion further comprises a first sloping surface for guiding the flexible printed circuit.

2. The connection device of claim 1, wherein the distance between the first bulge portion and the third bulge portion is larger than the distance between the second bulge portion and the fourth bulge portion.

3. The connection device of claim 1, wherein the first bulge portion further comprises a first surface for clamping the flexible printed circuit.

4. The connection device of claim 1, wherein the third bulge portion further comprises a second surface for clamping the flexible printed circuit.

5. The connection device of claim 1, wherein the second bulge portion further comprises a first conductive layer for electrically coupling to the flexible printed circuit.

6. The connection device of claim 1, wherein the fourth bulge portion further comprises a second conductive layer for electrically coupling to the flexible printed circuit.

7. The connection device of claim 1, wherein a first angle between 30 and 60 degrees is formed between the first sloping surface and the surface of the flexible printed circuit.

8. The connection device of claim 1, wherein the fourth bulge portion further comprises a second sloping surface for guiding the flexible printed circuit.

9. The connection device of claim 8, wherein a second angle between 30 and 60 degrees is formed between the second sloping surface and the surface of the flexible printed circuit.

10. A connection device for connecting a flat flex cable, the connection device comprising:

a dielectric housing, the dielectric housing including a slot for the flat flex cable plugging in, the slot defining a top surface and a bottom surface;

a first bulge portion and a second bulge portion downward extending from the top surface of the slot; and a third bulge portion and a fourth bulge portion upward extending from the bottom surface of the slot;

wherein the first bulge portion corresponds to the third bulge portion, and a distance between the first bulge portion and the third bulge portion is smaller than a thickness of the flat flex cable for clamping the flat flex cable, and wherein the second bulge portion corresponds to the fourth bulge portion for electrically coupling to the flat flex cable, and wherein the second bulge portion further comprises a first sloping surface for guiding the flat flex cable.

11. The connection device of claim 10, wherein the distance between the first bulge portion and the third bulge portion is larger than the distance between the second bulge portion and the fourth bulge portion.

12. The connection device of claim 10, wherein the first bulge portion further comprises a first surface for clamping the flat flex cable.

13. The connection device of claim 10, wherein the third bulge portion further comprises a second surface for clamping the flat flex cable.

14. The connection device of claim 10, wherein the second bulge portion further comprises a first conductive layer for electrically coupling to the flat flex cable.

15. The connection device of claim 10, wherein the forth bulge portion further comprises a second conductive layer for electrically coupling to the flat flex cable.

16. The connection device of claim 10, wherein a first angle between 30 and 60 degrees is formed between the first sloping surface and the surface of the flat flex cable.

17. The connection device of claim 10, wherein the fourth bulge portion further comprises a second sloping surface for guiding the flat flex cable.

18. The connection device of claim 17, wherein a second angle between 30 and 60 degrees is formed between the second sloping surface and the surface of the flat flex cable.

* * * * *